US011195445B2

(12) United States Patent
Shan

(10) Patent No.: US 11,195,445 B2
(45) Date of Patent: Dec. 7, 2021

(54) DRIVING APPARATUS AND DRIVING METHOD OF A DISPLAY APPARATUS

(71) Applicant: HKC CORPORATION LIMITED, Guangdong (CN)

(72) Inventor: Jianfeng Shan, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 7 days.

(21) Appl. No.: 16/760,082

(22) PCT Filed: Feb. 13, 2018

(86) PCT No.: PCT/CN2018/076593
§ 371 (c)(1),
(2) Date: Apr. 29, 2020

(87) PCT Pub. No.: WO2019/085346
PCT Pub. Date: May 9, 2019

(65) Prior Publication Data

US 2021/0049946 A1 Feb. 18, 2021

(30) Foreign Application Priority Data

Nov. 3, 2017 (CN) ..... 201711069349.0

(51) Int. Cl.
*G09G 3/20* (2006.01)

(52) U.S. Cl.
CPC ..... *G09G 3/2003* (2013.01); *G09G 2310/027* (2013.01); *G09G 2320/0242* (2013.01)

(58) Field of Classification Search
None
See application file for complete search history.

(56) References Cited

U.S. PATENT DOCUMENTS

2009/0251483 A1* 10/2009 Hsu ..... G09G 3/2055 345/589
2016/0189670 A1* 6/2016 Kim ..... G09G 5/02 345/690

FOREIGN PATENT DOCUMENTS

| | | | |
|---|---|---|---|
| CN | 101207710 | A | 6/2008 |
| CN | 104299565 | A | 1/2015 |
| CN | 106935173 | A | 7/2017 |
| CN | 106971695 | A | 7/2017 |
| WO | WO2008/114521 | A1 | 9/2018 |

* cited by examiner

*Primary Examiner* — Aneeta Yodichkas
(74) *Attorney, Agent, or Firm* — Muncy, Geissler, Olds & Lowe, P.C.

(57) ABSTRACT

This application discloses a driving method and a driving apparatus of a display device. The driving method comprises: acquiring a target color system which is to-be-adjusted, acquiring color shift grayscales corresponding to a color shift generated by the target color system, acquiring original grayscales corresponding to the target color system in an input signal, deleting a portion of color shift grayscales in the original grayscales, obtaining mapping grayscales corresponding to the target color system, adopting a high-bit drive semiconductor element or a frame ratio control, and outputting a signal of the mapping grayscales corresponding to the target color system.

13 Claims, 4 Drawing Sheets

DRIVING APPARATUS AND DRIVING METHOD OF A DISPLAY APPARATUS

CROSS REFERENCE TO RELATED APPLICATIONS

This application claims priority on Patent Application No(s). 2017110693490, whose title is "DRIVING APPARATUS AND DRIVING METHOD OF A DISPLAY APPARATUS," filed in People's Republic of China on Nov. 3, 2017, and the entire contents of which are hereby incorporated by reference.

BACKGROUND OF THE INVENTION

Field of Invention

This disclosure relates to a technical field of a display, and more particularly to a driving apparatus and a driving method thereof.

Related Art

In a liquid crystal display, because of the correlation between the refractivity and the wavelength, different wavelengths of transmittance relate to the phase delay, thereby rendering different levels of performance between the transmittance and the wavelength. In addition, with the voltage drive changes, different wavelengths of phase delays also generate different levels of changes to affect different wavelengths of transmittance performance.

Taking the property of a vertical alignment (VA) mode property as an example, when the voltage drive changes from the high voltage to the low voltage, the color purity is significantly affected. More specifically, the color saturation is very garish at the high voltage; when the voltage drives downwards, the color garishness decreases. Taking the 8-bit display capable of rendering different grayscales (0 to 255) of displays as an example, the high grayscales have the significant saturation and are very garish, but the low grayscales have the decreased color garishness.

SUMMARY OF THE INVENTION

Accordingly, it is necessary to provide a driving apparatus and a driving method thereof capable of significantly improving the color shift picture quality to solve the problem of the defect present in the color shift picture quality of the general display device.

A driving method of a display device, comprising the following steps: acquiring a target color system which is to-be-adjusted; acquiring original grayscales corresponding to the target color system in an input signal and color shift grayscales corresponding to a color shift generated by the target color system; deleting a portion of the original grayscales corresponding to the target color system which is smaller than the color shift grayscales to obtain mapping grayscales corresponding to the target color system, and adopting a high-bit drive semiconductor element or a frame ratio control, and outputting a signal of the mapping grayscales corresponding to the target color system, wherein the high bit is higher than the original bit corresponding to the input signal.

In one embodiment, during acquiring the color shift grayscales corresponding to the color shift generated by the target color system, the method further comprises: acquiring a chromaticity variation curve of the target color system, and acquiring the color shift grayscales corresponding to the color shift generated by the target color system according to the chromaticity variation curve.

In one embodiment, during acquiring the target color system which is to-be-adjusted, the method further comprises: acquiring color shift condition data corresponding to each color system from the input signal, and selecting the color with the maximum color shift value as the target color system.

In one embodiment, during acquiring the target color system which is to-be-adjusted, the method further comprises: acquiring color shift condition data corresponding to each color system from the input signal, and selecting the color with the minimum color shift value as the target color system.

In one embodiment, during acquiring the target color system which is to-be-adjusted, the method further comprises: acquiring color shift condition data corresponding to each color system from the input signal; and selecting the color with the maximum color shift value and the color with the second highest color shift value as the target color system.

In one embodiment, the target color system is a solid color, and before the step of adopting the high-bit drive semiconductor element or the frame ratio control and outputting the signal of the mapping grayscales corresponding to the target color system, the method further comprises: acquiring the original grayscales corresponding to each color system from the input signal, and deleting the portion of the original grayscales corresponding to each color system which is lower than the color shift grayscales to obtain the mapping grayscales corresponding to each color system. During adopting the high-bit drive semiconductor element or the frame ratio control and outputting the signal of the mapping grayscales corresponding to the target color system, the method further comprises: adopting the high-bit drive semiconductor element or the frame ratio control and outputting the signal of the mapping grayscales corresponding to each color system In one embodiment, during acquiring original grayscales corresponding to the target color system in the input signal, the method further comprises: acquiring a configuration parameter of the display device, and acquiring the original grayscales corresponding to the target color system from the input signal according to the configuration parameter.

In one embodiment, the original grayscales range from 0 to 255*M grayscales, the color shift grayscales corresponding to red range from 0 to 55*M grayscales, the color shift grayscales corresponding to green range from 0 to 31*M grayscales, and the color shift grayscales corresponding to blue range from 0 to 59*M grayscales, and M is an even number.

In one embodiment, the original grayscales range from 0 to 255 grayscales, the color shift grayscales corresponding to red range from 0 to 55 grayscales, the color shift grayscales corresponding to green range from 0 to 31 grayscales, and the color shift grayscales corresponding to blue range from 0 to 59 grayscales.

In one embodiment, the original grayscales range from 0 to 255*M grayscales, the mapping grayscales corresponding to red range from 56*M to 255*M grayscales, the mapping grayscales corresponding to green range from 32*M to 255*M grayscales, and the mapping grayscales corresponding to green range from 60*M to 255*M grayscales, and M is an even number.

In one embodiment, the original grayscales range from 0 to 255 grayscales, the mapping grayscales corresponding to red range from 56 to 255 grayscales, the mapping grayscales corresponding to green range from 32 to 255 grayscales, and the mapping grayscales corresponding to green range from 60 to 255 grayscales.

In one embodiment, the original bits corresponding to the input signal are 8 bits, and the high bits are 10 bits or 12 bits.

A driving apparatus of a display device, comprising: a color system selecting module for acquiring a target color system which is to-be-adjusted; a grayscale acquiring module for acquiring original grayscales corresponding to the target color system in an input signal and color shift grayscales corresponding to the color shift generated by the target color system; a grayscale mapping module for deleting a portion of the original grayscales corresponding to the target color system which is smaller than the color shift grayscales and obtaining mapping grayscales corresponding to the target color system, and an output module for adopting a high-bit drive semiconductor element or a frame ratio control and outputting the signal of the mapping grayscales corresponding to the target color system, wherein the high bit is higher than the original bit corresponding to the input signal.

In one embodiment, the color system selecting module comprises: an acquiring unit for acquiring the color shift condition data corresponding to each color system from the input signal, and a selecting unit for selecting the color with the minimum color shift value as the target color system, or selecting the color with the maximum color shift value as the target color system In one embodiment, the grayscale acquiring module further acquires a chromaticity variation curve of the target color system, and acquires the color shift grayscales corresponding to the color shift generated by the target color system according to the chromaticity variation curve.

In one embodiment, the target color system is a solid color, and the output module further acquires the original grayscales corresponding to each of the color systems from the input signal, deletes a portion of the original grayscales corresponding to each of the color systems and being lower than the color shift grayscales to obtain the mapping grayscales corresponding to each of the color systems, and adopts a high-bit drive semiconductor element or frame ratio control to output the signal of the mapping grayscales corresponding to each of the color systems.

In one embodiment, the grayscale acquiring module further acquires a configuration parameter of the display device, and acquires the original grayscales corresponding to the target color system from the input signal according to the configuration parameter.

In one embodiment, the original grayscales range from 0 to 255 grayscales, the color shift grayscales corresponding to red range from 0 to 55 grayscales, the color shift grayscales corresponding to green range from 0 to 31 grayscales, and the color shift grayscales corresponding to blue range from 0 to 59 grayscales.

In one embodiment, the original grayscales range from 0 to 255 grayscales, the mapping grayscales corresponding to red range from 56 to 255 grayscales, the mapping grayscales corresponding to green range from 32 to 255 grayscales, and the mapping grayscales corresponding to blue range from 60 to 255 grayscales.

A driving method of a display device, wherein the target color system is a solid color, the method comprising: acquiring color shift condition data corresponding to each color system from a input signal; selecting the color with the minimum color shift value as the target color system, or selecting the color with the maximum color shift value as the target color system, or selecting the color with the maximum color shift value and the color with the second highest color shift value as the target color system; acquiring original grayscales corresponding to the target color system in the input signal, acquiring a chromaticity variation curve of the target color system, and acquiring the color shift grayscales corresponding to the color shift generated by the target color system according to the chromaticity variation curve; acquiring the original grayscales corresponding to each color system from the input signal; deleting a portion of the original grayscales corresponding to each color system which is lower than the color shift grayscales to obtain the mapping grayscales corresponding to each color system, and adopting a high-bit drive semiconductor element or a frame ratio control, and outputting a signal of the mapping grayscales corresponding to each color system.

For the driving method and the driving apparatus of the display device of the invention, the to-be-adjusted target color system is acquired; the color shift grayscales corresponding to the color shift generated by the target color system is acquired, and the original grayscales corresponding to the target color system from the input signal is acquired; the portion of the color shift grayscales from the original grayscales is deleted; the mapping grayscales corresponding to the target color system is obtained; the high-bit drive semiconductor element or the frame ratio control is adopted, and the signal of the mapping grayscales corresponding to the target color system is outputted. In the overall process, the low grayscales affecting the garishness performance in the target color system are deleted, and the high-bit drive semiconductor element or the frame ratio control is adopted to output the signal to effectively improve the color shift picture quality of the display device without sacrificing the performance of the full grayscale resolution.

BRIEF DESCRIPTION OF THE DRAWINGS

The accompanying drawings are included to provide a further understanding of embodiments of the present disclosure, which constitutes a part of the specification, illustrate embodiments of the present disclosure is used, together and explain the principles of the present disclosure with the description. Apparently, the drawings in the following description are only some embodiments of the present disclosure, those of ordinary skill in the art is concerned, without any creative effort, and may also obtain other drawings based on these drawings. In the drawings.

DETAILED DESCRIPTION OF THE INVENTION

For describing the driving method and driving apparatus of a display device disclosed by the present application in detail, some related inventive concepts and the technical plans are introduced as below.

Specific structures and function details disclosed herein are only for the illustrative purpose for describing the exemplary embodiment of this disclosure. However, this disclosure can be specifically implemented through many replacements, and should not be explained as being restricted to only the embodiment disclosed herein.

In a display device (e.g., a liquid crystal display), because of the correlation between the refractivity and the wavelength, different wavelengths of transmittance relate to the phase delay, thereby rendering different levels of performance between the transmittance and the wavelength. In addition, with the voltage drive changes, different wavelengths of phase delays also generate different levels of changes to affect different wavelengths of transmittance performance. For example, look at the display property of the VA mode on the 1976 UV chromaticity coordinate map of the Commission Internationale de L'Eclairage (CIE), when the voltage drive changes from the high voltage to the low voltage, the color purity is obviously affected. The color saturation is very garish at the high voltage, and the color garishness decreases when the voltage drives downwards. That is, when the 8-bit display can render different grayscales (0 to 255) of displays, the high grayscales significantly cause the very garish saturation, but the low grayscales decrease the color garishness.

Figure 1:
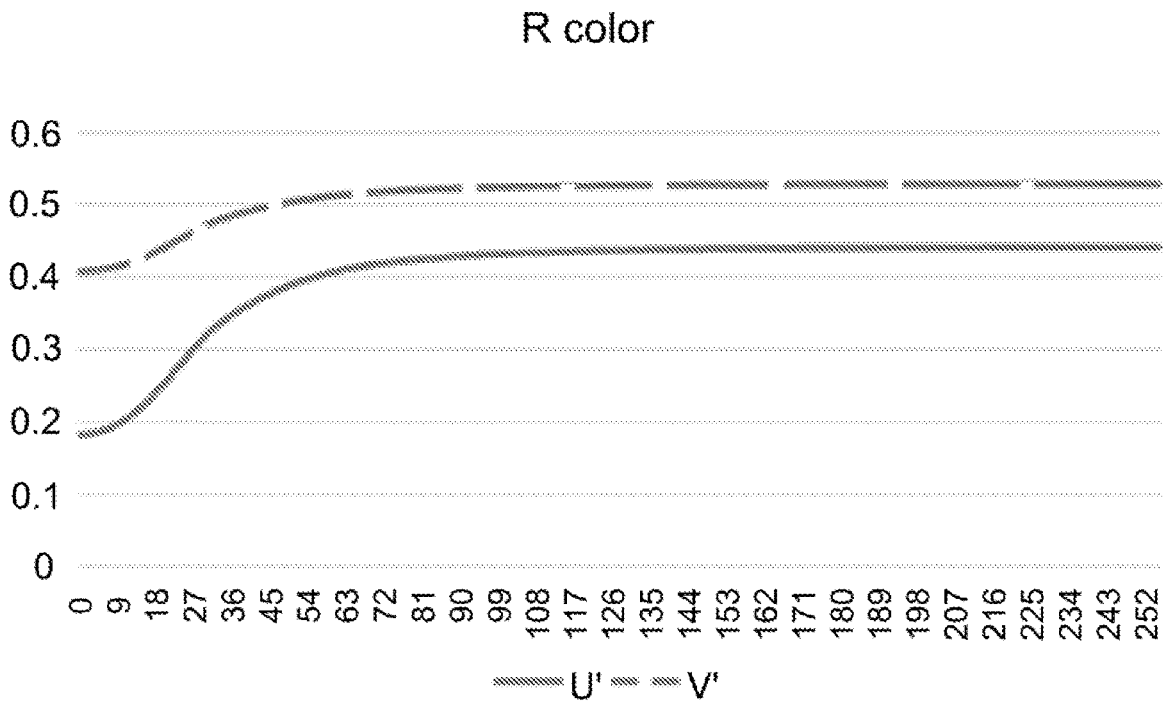
FIG. 1 is a schematic view showing a chromaticity variation curve of red.
Figure 2:
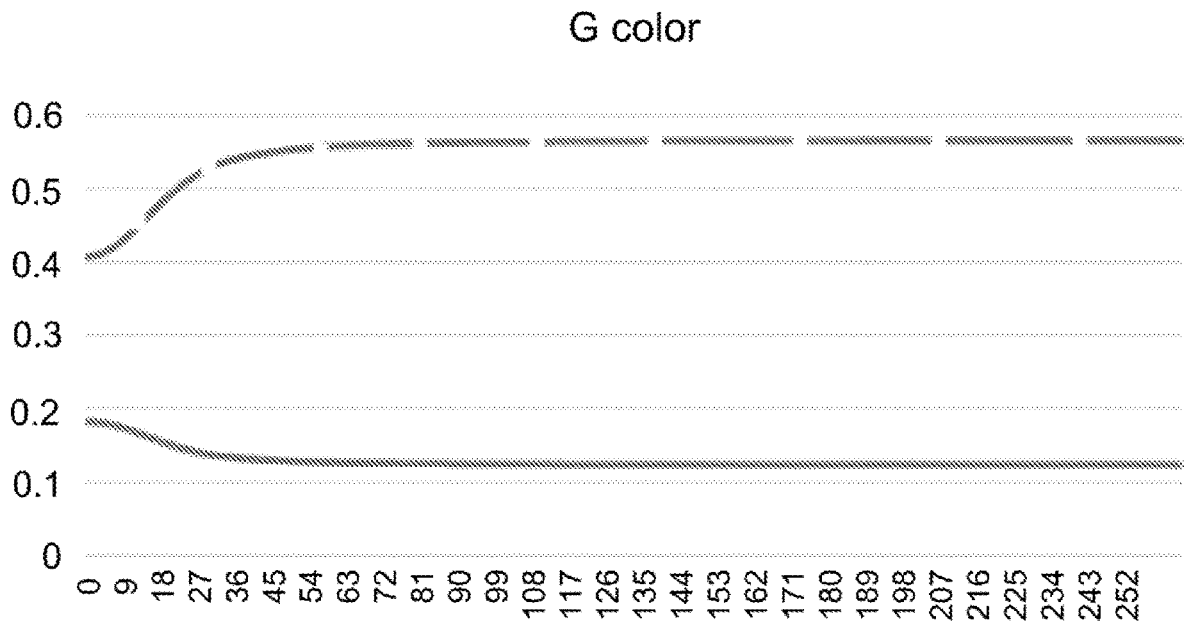
FIG. 2 is a schematic view showing a chromaticity variation curve of green.
Figure 3:
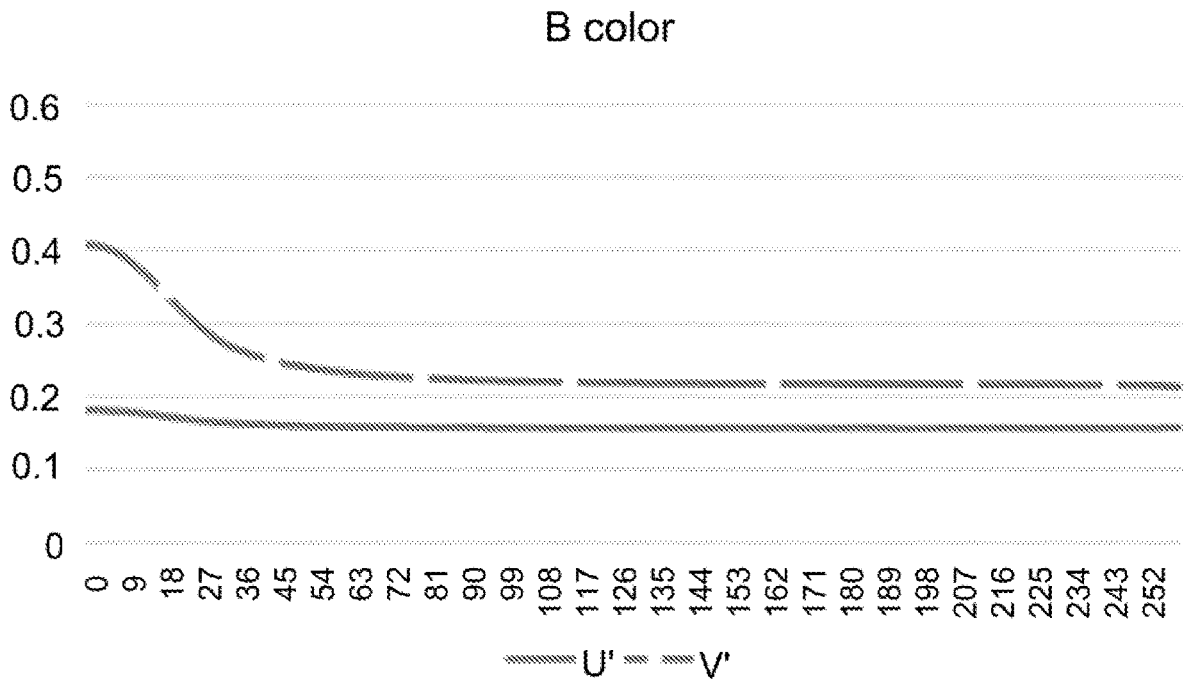
FIG. 3 is a schematic view showing a chromaticity variation curve of blue.

It is found from further study that, as shown in FIGS. 1 to 3, when the V-T curve of the panel is designed in the condition of the public version 2.2, the individual CIE 1976 UV chromaticity of the RGB (red, green, blue) changes. It is possible to observe that the color garishness of R starts to be affected by different wavelengths of different phase delay ratios and the light leakage of GB sub-pixels at the grayscale of 56 so that the color garishness decreases, the color garishness of G starts to be affected by different wavelengths of different phase delay ratios and the light leakage of RB sub-pixels at the grayscale of 32 so that the color garishness decreases, and the color garishness of B starts to be affected by different wavelengths of different phase delay ratios and the light leakage of RG sub-pixels at the grayscale of 60 so that the color garishness decreases. It is found from further study that the decrease of the color garishness of each of RGB colors also responds at the viewing angle observation, wherein the trend of changing of the color garishness of each of RGB colors observed at the viewing angle of 60 degrees with the grayscale in the horizontal direction is the same as the condition observed at the front viewing angle. The color saturation becomes very garish at the high voltage, and the color garishness decreases when the voltage drives downwards. Red (R) is the color of the long-wave end in the visible spectrum, and has the wavelength ranging from about 610 to 750 nanometers. Green (G) is the mid-wavelength portion of the visible spectrum, and has the wavelength ranging from 492 to 577 nanometers. Blue (B) is one of the three primary colors of red, green and blue light and has the shortest wavelength ranging from 440 to 475 nanometers among the three primary colors.

It is further found, from further study in the color shift changes at the large viewing angle and the front viewing angle for various representative color systems of the display device, that the color shift conditions at the large viewing angle for the color systems biased to the R, G and B colors are more serious than other color systems. Thus, solving the color shift defect of the R, G and B colors can significantly enhance the overall color shift improvement at the large viewing angle.

Figure 4:
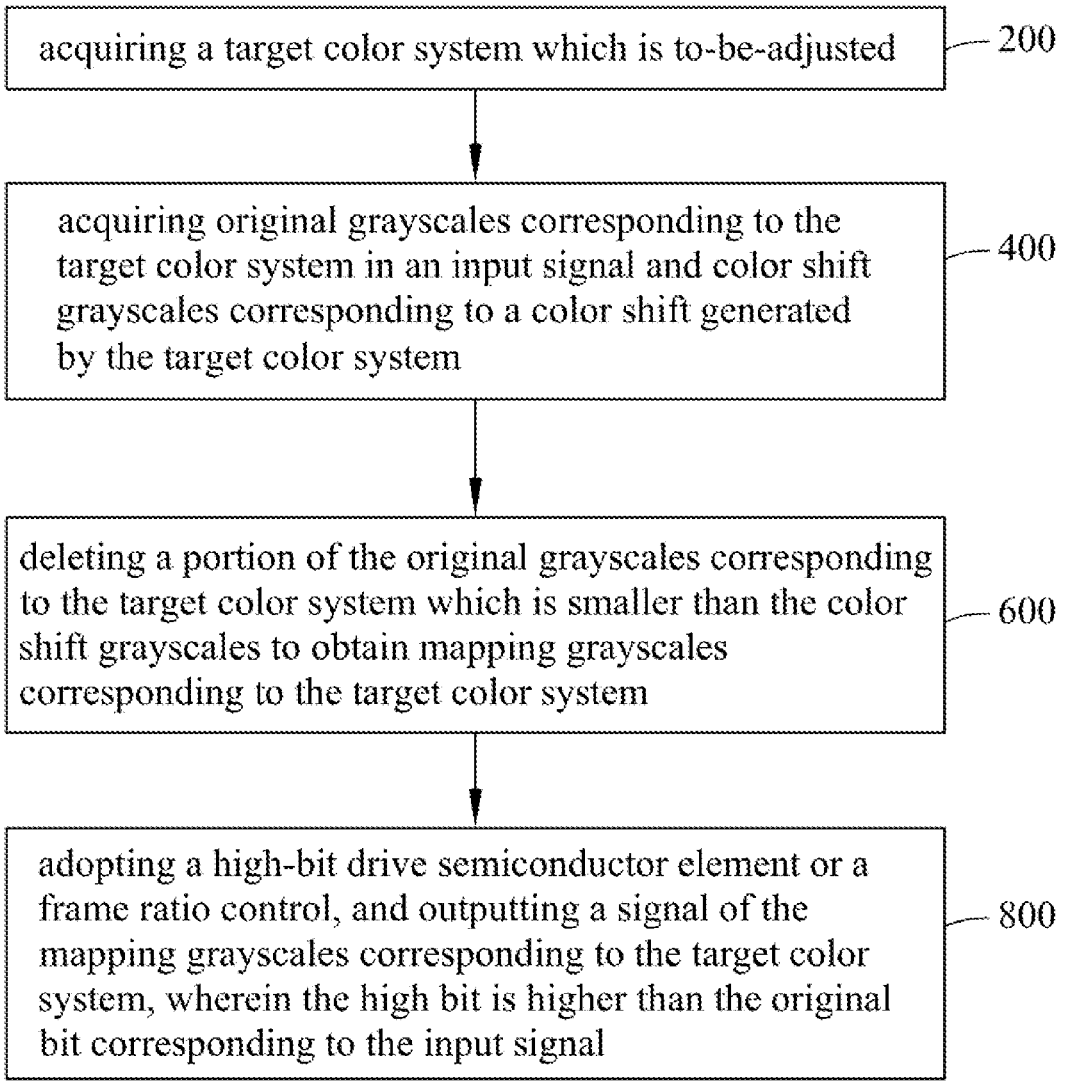
FIG. 4 is a schematic flow chart showing a driving method of a display device according to one of embodiments of the invention.

Referring to FIG. 4, a driving method of a display device includes steps S200 and S400.

In S200, a to-be-adjusted target color system is acquired.

On one hand, the to-be-adjusted target color system can be selected according to the required condition of the actual condition. On the other hand, the to-be-adjusted target color system can be selected according to the color shift condition corresponding to each color system. As mentioned hereinabove, the color shift conditions at the large viewing angle for the color systems biased to the R, G and B colors are more serious than other color systems. Thus, solving all or one of the color shift defects in the R, G and B colors can effectively improve the overall color shift condition at the large viewing angle. That is, all or some of colors of the R, G and B colors may be selected to function as the target color system. Further, it is also possible to select the color with the most or least serious color shift to function as the target color system according to the color shift conditions corresponding to the R, G and B colors.

In S400, original grayscales corresponding to the target color system in the input signal and color shift grayscales corresponding to the color shift generated by the target color system are acquired.

The so-called grayscales are defined by dividing a brightness change between the brightest brightness and the darkest brightness into several divisions, so that the screen brightness control corresponding to the signal input can be performed. The original grayscales corresponding to the color system in the input signal relate to the configuration of the display device. For example, the 8-bit display has $2^8$ original grayscales (i.e., the grayscales ranging from 0 to 255) corresponding to the color system. Thus, the original grayscales corresponding to the target color system in the input signal of the 8-bit display range from 0 to 255.

As mentioned hereinabove, the color generates the color shift condition in the condition of the low grayscales, and every different color has the critical point grayscale corresponding to the generation of the color shift, wherein the grayscales lower than the critical point grayscale are the grayscales corresponding to the generation of the color shift in the color system. More specifically, it is observed from FIGS. 1 to 3 that the color garishness of R starts to be affected by different wavelengths of different phase delay ratios and the light leakage of the GB sub-pixels at the grayscale of 56 so that the color garishness decreases. That is, the critical point grayscale where the R color correspondingly generates the color shift is 56, wherein the portion of the grayscales ranging from 0 to 55 is the corresponding grayscales where the R color generates the color shift. In other words, the portion of the grayscales ranging from 0 to 55 pertains to the color shift grayscales (low grayscales) of the R color. The color garishness of G starts to be affected by different wavelengths of different phase delay ratios and the light leakage of RB sub-pixels at the grayscale of 32 so that the color garishness decreases. That is, the critical point grayscale where the G color correspondingly generates the color shift is 32, the portion of the grayscales ranging from 0 to 31 is the corresponding grayscales where the G color generates the color shift. In other words, the portion of the grayscales ranging from 0 to 31 pertains to the color shift grayscales of the G color. The color garishness of B starts to be affected by different wavelengths of different phase delay ratios and the light leakage of RG sub-pixels at the grayscale of 60 so that the color garishness decreases. That is, the critical point grayscale where the B color correspondingly generates the color shift is 60. The portion of the grayscales ranging from 0 to 59 is the corresponding grayscales where the B color generates the color shift.

In S600, a portion of the original grayscales corresponding to the target color system and being smaller than the color shift grayscales is deleted to obtain mapping grayscales corresponding to the target color system.

If the target color system obtained in the step S200 is the B color, the original grayscales of the B color obtained in the step S400 range from 0 to 255, and the color shift grayscales thereof range from 0 to 59, then in this step S600, the portion of the color shift grayscales ranging from 0 to 59 in the original grayscales ranging from 0 to 255 is deleted to obtain the mapping grayscales ranging from 60 to 255 corresponding to the B color of the color system. The above-mentioned similar processing methods are adopted with regard to the display to be improved to the R color or G color, and detailed descriptions thereof will be omitted herein. Furthermore, the adjusted design is made on the 8-bit RGB grayscale display color (capable of displaying the grayscales ranging from 0 to 255) of the liquid crystal display. When the input of the input signal ranges from 0 to 255, the look-up-table (LUT) values of a look-up-table (display LUT) are established according to the color shift change trends of the R, G and B displays themselves (after the LUT writes the data into the storage medium in advance, inputting one signal is equivalent to inputting one address for looking up the table to find the content corresponding to the address and then output the content). The purpose is to remove the grayscales of the low grayscales where the color shift is easily generated. Please refer to the following Table 1.

Table 1 shows the corresponding relationship table of each color system before and after the portion of the original grayscales corresponding to the color system and being smaller than the color shift grayscales is deleted.

TABLE 1

| Original grayscales (8 bits) | | | Mapping grayscales (8 bits) | | |
|---|---|---|---|---|---|
| R | G | B | R | G | B |
| 0 | 0 | 0 | 56 | 32 | 60 |
| 1 | 1 | 1 | 57 | 33 | 61 |
| 2 | 2 | 2 | 58 | 34 | 62 |
| 3 | 3 | 3 | 58 | 35 | 62 |
| 4 | 4 | 4 | 59 | 35 | 63 |
| 5 | 5 | 5 | 60 | 36 | 64 |
| 6 | 6 | 6 | 61 | 37 | 65 |
| 7 | 7 | 7 | 61 | 38 | 65 |
| 8 | 8 | 8 | 62 | 39 | 66 |
| 9 | 9 | 9 | 63 | 40 | 67 |
| . | . | . | . | . | . |
| . | . | . | . | . | . |
| . | . | . | . | . | . |
| 244 | 244 | 244 | 246 | 245 | 247 |
| 245 | 245 | 245 | 247 | 246 | 247 |
| 246 | 246 | 246 | 248 | 247 | 248 |
| 247 | 247 | 247 | 249 | 248 | 249 |
| 248 | 248 | 248 | 250 | 249 | 250 |
| 249 | 249 | 249 | 250 | 250 | 250 |
| 250 | 250 | 250 | 251 | 251 | 251 |
| 251 | 251 | 251 | 252 | 252 | 252 |
| 252 | 252 | 252 | 253 | 252 | 253 |
| 253 | 253 | 253 | 253 | 253 | 253 |
| 254 | 254 | 254 | 254 | 254 | 254 |
| 255 | 255 | 255 | 255 | 255 | 255 |

In S800, a high-bit drive semiconductor element or a frame ratio control is adopted to output the signal of the mapping grayscales corresponding to the target color system, wherein the high bit is higher than the original bit corresponding to the input signal.

It is found, after studying Table 1, that the drawback of outputting after directly adopting the processing of Table 1 causes the insufficient grayscale resolution by directly deleting the low grayscales of the color shift, wherein different grayscales of input signals need to use the same grayscale signal for output because the grayscale number is decreased. When the R input signal of Table 1 is the grayscale of 2 and the grayscale of 3, the output must be the grayscale of 58, the overall color grayscale resolution is decreased, so the further processing is needed. The specific details are listed in Table 2, wherein the 8-bit grayscale signal is applied with the high-bit drive semiconductor element or the frame ratio control (10 bits and 12 bits in Table 2) for the grayscale output to ensure that the output grayscale signals cannot repeat, thereby decreasing the possibility of the occurrence of the sacrificed resolution. The high bit is higher than the original bit corresponding to the input signal. For example, in the above-mentioned embodiment, the original bit of the input signal of the display device is 8 bits, so 10 bits and 12 bits can be chosen. The high bit is a relative concept and refers to the bit higher than the original bit corresponding to the input signal. For example, when the original bit corresponding to the input signal is 8, the high bit may be the arbitrary bit, such as 10 bits, 12 bits or the like, higher than 8. When the original bit corresponding to the input signal is 10, the high bit may be the arbitrary bit, such as 12 bits, higher than 10. The high-bit drive semiconductor element may be specifically the high bit drive chip or the integrated circuit.

Table 2 is the mapping grayscale table after the processing of the high-bit drive semiconductor element or the frame ratio control (10/12 bits).

TABLE 2

| Original grayscales (8 bits) | | | Mapping grayscales (10 bits) | | | Mapping grayscales (12 bits) | | |
|---|---|---|---|---|---|---|---|---|
| R | G | B | R | G | B | R | G | B |
| 0 | 0 | 0 | 112 | 64 | 120 | 224 | 128 | 240 |
| 1 | 1 | 1 | 114 | 66 | 122 | 227 | 131 | 243 |
| 2 | 2 | 2 | 115 | 67 | 123 | 230 | 135 | 246 |
| 3 | 3 | 3 | 117 | 69 | 125 | 233 | 138 | 249 |
| 4 | 4 | 4 | 118 | 71 | 126 | 236 | 142 | 252 |
| 5 | 5 | 5 | 120 | 73 | 128 | 240 | 145 | 255 |
| 6 | 6 | 6 | 121 | 74 | 129 | 243 | 149 | 258 |
| 7 | 7 | 7 | 123 | 76 | 131 | 246 | 152 | 261 |
| 8 | 8 | 8 | 124 | 78 | 132 | 249 | 156 | 264 |
| 9 | 9 | 9 | 126 | 80 | 134 | 252 | 159 | 268 |
| . | . | . | . | . | . | . | . | . |
| . | . | . | . | . | . | . | . | . |
| . | . | . | . | . | . | . | . | . |
| 244 | 244 | 244 | 493 | 491 | 493 | 986 | 982 | 986 |
| 245 | 245 | 245 | 494 | 493 | 495 | 989 | 985 | 989 |
| 246 | 246 | 246 | 496 | 494 | 496 | 992 | 989 | 992 |
| 247 | 247 | 247 | 498 | 496 | 498 | 995 | 992 | 996 |
| 248 | 248 | 248 | 499 | 498 | 499 | 998 | 996 | 999 |
| 249 | 249 | 249 | 501 | 500 | 501 | 1001 | 999 | 1002 |
| 250 | 250 | 250 | 502 | 501 | 502 | 1004 | 1003 | 1005 |
| 251 | 251 | 251 | 504 | 503 | 504 | 1008 | 1006 | 1008 |
| 252 | 252 | 252 | 505 | 505 | 505 | 1011 | 1010 | 1011 |
| 253 | 253 | 253 | 507 | 507 | 507 | 1014 | 1013 | 1014 |
| 254 | 254 | 254 | 508 | 508 | 508 | 1017 | 1017 | 1017 |
| 255 | 255 | 255 | 510 | 510 | 510 | 1020 | 1020 | 1020 |

In the driving method of the display device of the present embodiment, the to-be-adjusted target color system is acquired; the color shift grayscales corresponding to the color shift generated by the target color system is acquired, and the original grayscales corresponding to the target color system from the input signal is acquired; the portion of the color shift grayscales from the original grayscales is deleted; the mapping grayscales corresponding to the target color system is obtained; the high-bit drive semiconductor element or the frame ratio control is adopted, and the signal of the mapping grayscales corresponding to the target color system is outputted. In the overall process, the low grayscales affecting the garishness performance in the target color system are deleted, and the high-bit drive semiconductor element or the frame ratio control is adopted to output the signal to effectively improve the color shift picture quality of the display device without sacrificing the performance of the full grayscale resolution.

In one embodiment, the step of acquiring the color shift grayscales corresponding to the color shift generated by the target color system includes: acquiring a chromaticity variation curve of the target color system; and acquiring the color shift grayscales corresponding to the color shift generated by the target color system according to the chromaticity variation curve.

The details of the chromaticity variation curve may refer to FIGS. 1 to 3, wherein the color shift grayscales corresponding to each color system may be accurately acquired based on the curve. That is, it is possible to acquire the color shift grayscales corresponding to the color shift generated by the target color system. The chromaticity variation curve may be obtained according to the historical experience data and the experimental data.

In one embodiment, the step of acquiring the to-be-adjusted target color system includes: acquiring the color shift condition data corresponding to each color system from the input signal; and selecting the color with the maximum color shift value as the target color system.

In one embodiment, the step of acquiring the to-be-adjusted target color system includes: acquiring the color shift condition data corresponding to each color system from the input signal; and selecting the color with the minimum color shift value as the target color system.

The color shift value is the parameter value for representing the color shift degree, wherein the larger color shift value corresponds to the more serious color shift condition. On the contrary, the smaller color shift value corresponds to the less serious color shift condition. Herein, it is possible to successively sort the color shift values corresponding to each color system in the order from high to low or from low to high based on the color shift condition data corresponding to each color system in the input signal, and to obtain the color shift condition sequence of each color system. Then, the color corresponding to the maximum color shift value (the color shift condition is most serious) is selected therefrom, or the color corresponding to the minimum color shift value (the color shift condition is least serious) is selected therefrom.

In one embodiment, the step of acquiring the to-be-adjusted target color system includes: acquiring the color shift condition data corresponding to each color system from the input signal; and selecting the color with the maximum color shift value and the color with the second highest color shift value as the target color system.

In the input signal, the color shift condition data corresponding to each color system may be acquired based on the UV chromaticity variation curve corresponding to each color system. The color with the second highest color shift value refers to the color with the second most serious color shift condition. For example, if red, green and blue are currently present, and the color shift condition sequence of their corresponding color shift values from high to low is red, green and blue, then the color with the maximum color shift value is red, and the color shift condition thereof is the most serious; the color with the second highest color shift value is green, and the color shift condition thereof is the second most serious; and the color with the minimum color shift value is blue, and the color shift condition thereof is least serious.

In one embodiment, the target color system is a solid color.

Before the step of adopting the high-bit drive semiconductor element or the frame ratio control to output the signal of the mapping grayscales corresponding to the target color system, the method further includes the steps of: acquiring the original grayscales corresponding to each color system from the input signal; and deleting the portion of the original grayscales corresponding to each color system and being lower than the color shift grayscales to obtain the mapping grayscales corresponding to each color system.

The step of adopting the high-bit drive semiconductor element or the frame ratio control to output the signal of the mapping grayscales corresponding to the target color system includes: adopting the high-bit drive semiconductor element or the frame ratio control to output a signal of the mapping grayscales corresponding to each color system.

In this embodiment, in addition to the adjustment of the grayscales of the target color system, the original grayscales in each color system (exclusive of the target color system) in the input signal are further adjusted. The adjustment may specifically align the original grayscales of the non-target color system in each color system with the mapping grayscales corresponding to the target color system. That is, the portion of the original grayscales corresponding to each color system and being lower than the color shift grayscales is deleted to obtain the mapping grayscales corresponding to each color system. Then, the method the same as that needing to improve the display color is adopted, and the high-bit drive semiconductor element or the frame ratio control is adopted to output the signal of the mapping grayscales corresponding to each color system.

Taking the target color system of B color as an example and assuming that the color system in the input signal further includes the R color and the G color. The original grayscales range from 0 to 255. Based on FIGS. 1 to 3 and Table 1, it is obtained that the color shift grayscales of the B color range from 0 to 59, and the mapping grayscales of the B color range from 60 to 255. In this embodiment, for other color systems in the input signal (the R color and the G color), other color systems (the R color and the G color) in the input signal are aligned with the mapping grayscales (60 to 255) of the B color. That is, the portion (0 to 59) of the original grayscales (0 to 255) of the R color and the G color lower than the color shift grayscales of the B color is deleted to obtain the mapping grayscales of the R color ranging from 60 to 255, and the mapping grayscales of the G color ranging from 60 to 255. Then, the high-bit drive semiconductor element or the frame ratio control is adopted to output the mapping grayscales of the B color (60 to 255), the mapping grayscales of the R color (60 to 255) and the mapping grayscales of the G color (60 to 255).

Alternatively, in one embodiment, the target color system is a solid color, and the driving method of a display device comprises: acquiring color shift condition data corresponding to each color system from a input signal; selecting the color with the minimum color shift value as the target color system, or selecting the color with the maximum color shift value as the target color system, or selecting the color with the maximum color shift value and the color with the second highest color shift value as the target color system; acquiring original grayscales corresponding to the target color system in the input signal, acquiring a chromaticity variation curve of the target color system, and acquiring the color shift grayscales corresponding to the color shift generated by the target color system according to the chromaticity variation curve; acquiring the original grayscales corresponding to each color system from the input signal; deleting a portion of the original grayscales corresponding to each color system which is lower than the color shift grayscales to obtain the mapping grayscales corresponding to each color system, and adopting a high-bit drive semiconductor element or a frame ratio control, and outputting a signal of the mapping grayscales corresponding to each color system.

To further explain the technical solutions of the driving method for the display device of the invention in the foregoing several embodiments in detail, specific applicable embodiment will be used in conjunction with specific data to make the illustration.

The color systems which need to be improved include the R color, the G color and the B color.

Based on FIGS. 1 to 3, it is studied to find that the color shift grayscales of the R color range from 0 to 55, the color shift grayscales of the G color range from 0 to 31, and the color shift grayscales of the B color range from 0 to 59. In the input signal, the original grayscales of each color system range from 0 to 255, and a portion of the original grayscales corresponding to the target color system and being smaller than the color shift grayscales is deleted, so that the mapping grayscales of the R color ranging from 56 to 255, the mapping grayscales of the G color ranging from 32 to 255, and the mapping grayscales of the B color ranging from 60 to 255 are obtained. The specific corresponding relationship may refer to Table 1. The 10/12-bit drive semiconductor element or the frame ratio control is adopted to output the mapping grayscales of the R color ranging from 56 to 255, the mapping grayscales of the G color ranging from 32 to 255 and the mapping grayscales of the B color ranging from 60 to 255. The processed mapping grayscales may refer to Table 2.

The color system, which needs to be improved, is a solid color (B color) with the most serious color shift.

Alignment on the solid color with the most serious color shift is performed. Specifically, alignment on the B color with the most serious color shift is performed. The portion of the original grayscales lower than the color shift grayscales corresponding to the B color in each color system is deleted to obtain the mapping grayscales (60 to 255) of each color system. Then, the 10/12-bit drive semiconductor element or the frame ratio control is adopted to output the mapping grayscales of each color system, wherein the details are shown in Table 3.

Table 3 shows the mapping grayscales after alignment is performed on the solid color (B color) with the serious color shift and the mapping grayscales obtained after the 10/12-bit processing.

TABLE 3

| Original grayscales (8 bits) | | | Mapping grayscales (8 bits) | | | Mapping grayscales (10 bits) | | | Mapping grayscales (12 bits) | | |
|---|---|---|---|---|---|---|---|---|---|---|---|
| R | G | B | R | G | B | R | G | B | R | G | B |
| 0 | 0 | 0 | 60 | 60 | 60 | 120 | 120 | 120 | 240 | 240 | 240 |
| 1 | 1 | 1 | 61 | 61 | 61 | 122 | 122 | 122 | 243 | 243 | 243 |
| 2 | 2 | 2 | 62 | 62 | 62 | 123 | 123 | 123 | 246 | 246 | 246 |
| 3 | 3 | 3 | 62 | 62 | 62 | 125 | 125 | 125 | 249 | 249 | 249 |
| 4 | 4 | 4 | 63 | 63 | 63 | 126 | 126 | 126 | 252 | 252 | 252 |
| 5 | 5 | 5 | 64 | 64 | 64 | 128 | 128 | 128 | 255 | 255 | 255 |
| 6 | 6 | 6 | 65 | 65 | 65 | 129 | 129 | 129 | 258 | 258 | 258 |
| 7 | 7 | 7 | 65 | 65 | 65 | 131 | 131 | 131 | 261 | 261 | 261 |
| 8 | 8 | 8 | 66 | 66 | 66 | 132 | 132 | 132 | 264 | 264 | 264 |
| 9 | 9 | 9 | 67 | 67 | 67 | 134 | 134 | 134 | 268 | 268 | 268 |
| . | . | . | . | . | . | . | . | . | . | . | . |
| . | . | . | . | . | . | . | . | . | . | . | . |
| . | . | . | . | . | . | . | . | . | . | . | . |
| 244 | 244 | 244 | 247 | 247 | 247 | 493 | 493 | 493 | 986 | 986 | 986 |
| 245 | 245 | 245 | 247 | 247 | 247 | 495 | 495 | 495 | 989 | 989 | 989 |
| 246 | 246 | 246 | 248 | 248 | 248 | 496 | 496 | 496 | 992 | 992 | 992 |
| 247 | 247 | 247 | 249 | 249 | 249 | 498 | 498 | 498 | 996 | 996 | 996 |
| 248 | 248 | 248 | 250 | 250 | 250 | 499 | 499 | 499 | 999 | 999 | 999 |
| 249 | 249 | 249 | 250 | 250 | 250 | 501 | 501 | 501 | 1002 | 1002 | 1002 |
| 250 | 250 | 250 | 251 | 251 | 251 | 502 | 502 | 502 | 1005 | 1005 | 1005 |
| 251 | 251 | 251 | 252 | 252 | 252 | 504 | 504 | 504 | 1008 | 1008 | 1008 |
| 252 | 252 | 252 | 253 | 253 | 253 | 505 | 505 | 505 | 1011 | 1011 | 1011 |
| 253 | 253 | 253 | 253 | 253 | 253 | 507 | 507 | 507 | 1014 | 1014 | 1014 |
| 254 | 254 | 254 | 254 | 254 | 254 | 508 | 508 | 508 | 1017 | 1017 | 1017 |
| 255 | 255 | 255 | 255 | 255 | 255 | 510 | 510 | 510 | 1020 | 1020 | 1020 |

The color system, which needs to be improved, is the solid color (G color) with the least serious color shift.

The portion of the original grayscales lower than the color shift grayscales corresponding to the G color in each color system is deleted to obtain the mapping grayscales (32 to 255) of each color system. Then, the 10/12-bit drive semiconductor element or the frame ratio control is adopted to output the mapping grayscales of each color system, wherein the details are shown in Table 4.

Table 4 shows the mapping grayscales after alignment is performed on the solid color (G color) with the non-serious color shift and the mapping grayscales obtained after the 10/12-bit processing.

TABLE 4

| Original grayscales (8 bits) | | | Mapping grayscales (8 bits) | | | Mapping grayscales (10 bits) | | | Mapping grayscales (10 bits) | | |
|---|---|---|---|---|---|---|---|---|---|---|---|
| R | G | B | R | G | B | R | G | B | R | G | B |
| 0 | 0 | 0 | 32 | 32 | 32 | 64 | 64 | 64 | 128 | 128 | 128 |
| 1 | 1 | 1 | 33 | 33 | 33 | 66 | 66 | 66 | 131 | 131 | 131 |
| 2 | 2 | 2 | 34 | 34 | 34 | 67 | 67 | 67 | 135 | 135 | 135 |
| 3 | 3 | 3 | 35 | 35 | 35 | 69 | 69 | 69 | 138 | 138 | 138 |
| 4 | 4 | 4 | 35 | 35 | 35 | 71 | 71 | 71 | 142 | 142 | 142 |
| 5 | 5 | 5 | 36 | 36 | 36 | 73 | 73 | 73 | 145 | 145 | 145 |
| 6 | 6 | 6 | 37 | 37 | 37 | 74 | 74 | 74 | 149 | 149 | 149 |
| 7 | 7 | 7 | 38 | 38 | 38 | 76 | 76 | 76 | 152 | 152 | 152 |
| 8 | 8 | 8 | 39 | 39 | 39 | 78 | 78 | 78 | 156 | 156 | 156 |
| 9 | 9 | 9 | 40 | 40 | 40 | 80 | 80 | 80 | 159 | 159 | 159 |
| . | . | . | . | . | . | . | . | . | . | . | . |
| . | . | . | . | . | . | . | . | . | . | . | . |
| . | . | . | . | . | . | . | . | . | . | . | . |
| 244 | 244 | 244 | 245 | 245 | 245 | 491 | 491 | 491 | 982 | 982 | 982 |
| 245 | 245 | 245 | 246 | 246 | 246 | 493 | 493 | 493 | 985 | 985 | 985 |
| 246 | 246 | 246 | 247 | 247 | 247 | 494 | 494 | 494 | 989 | 989 | 989 |
| 247 | 247 | 247 | 248 | 248 | 248 | 496 | 496 | 496 | 992 | 992 | 992 |
| 248 | 248 | 248 | 249 | 249 | 249 | 498 | 498 | 498 | 996 | 996 | 996 |
| 249 | 249 | 249 | 250 | 250 | 250 | 500 | 500 | 500 | 999 | 999 | 999 |
| 250 | 250 | 250 | 251 | 251 | 251 | 501 | 501 | 501 | 1003 | 1003 | 1003 |
| 251 | 251 | 251 | 252 | 252 | 252 | 503 | 503 | 503 | 1006 | 1006 | 1006 |
| 252 | 252 | 252 | 252 | 252 | 252 | 505 | 505 | 505 | 1010 | 1010 | 1010 |
| 253 | 253 | 253 | 253 | 253 | 253 | 507 | 507 | 507 | 1013 | 1013 | 1013 |
| 254 | 254 | 254 | 254 | 254 | 254 | 508 | 508 | 508 | 1017 | 1017 | 1017 |
| 255 | 255 | 255 | 255 | 255 | 255 | 510 | 510 | 510 | 1020 | 1020 | 1020 |

The color with the most serious color shift is selected as the target color system, and the other color systems are kept at the original input signal.

Based on FIGS. 1 to 3, it is obtained that the color with the most serious color shift is the B color, and the color shift grayscales thereof range from 0 to 59.

The portion of the color shift grayscales is deleted from the original grayscales (0 to 255) to obtain the mapping grayscales ranging from 60 to 255. The other color systems in the input signal are kept at the grayscales of the original input signal, and then all the signals are outputted after adopting the 10/12-bit drive semiconductor element or the frame ratio control, and the details are shown in Table 5.

Table 5 is a grayscale table showing the B color with the serious color shift as the target color system, wherein the other color system is kept at the grayscales corresponding to the original input signal and obtained after the 10/12-bit processing is performed.

TABLE 5

| Original grayscales (8 bits) | | | Mapping grayscales (8 bits) | | | Mapping grayscales (10 bits) | | | Mapping grayscales (12 bits) | | |
|---|---|---|---|---|---|---|---|---|---|---|---|
| R | G | B | R | G | B | R | G | B | R | G | B |
| 0 | 0 | 0 | 0 | 0 | 60 | 0 | 0 | 120 | 0 | 0 | 240 |
| 1 | 1 | 1 | 1 | 1 | 61 | 2 | 2 | 122 | 4 | 4 | 243 |
| 2 | 2 | 2 | 2 | 2 | 62 | 4 | 4 | 123 | 8 | 8 | 246 |
| 3 | 3 | 3 | 3 | 3 | 62 | 6 | 6 | 125 | 12 | 12 | 249 |
| 4 | 4 | 4 | 4 | 4 | 63 | 8 | 8 | 126 | 16 | 16 | 252 |
| 5 | 5 | 5 | 5 | 5 | 64 | 10 | 10 | 128 | 20 | 20 | 255 |
| 6 | 6 | 6 | 6 | 6 | 65 | 12 | 12 | 129 | 24 | 24 | 258 |
| 7 | 7 | 7 | 7 | 7 | 65 | 14 | 14 | 131 | 28 | 28 | 261 |
| 8 | 8 | 8 | 8 | 8 | 66 | 16 | 16 | 132 | 32 | 32 | 264 |
| 9 | 9 | 9 | 9 | 9 | 67 | 18 | 18 | 134 | 36 | 36 | 268 |
| . | . | . | . | . | . | . | . | . | . | . | . |
| . | . | . | . | . | . | . | . | . | . | . | . |
| . | . | . | . | . | . | . | . | . | . | . | . |
| 244 | 244 | 244 | 244 | 244 | 247 | 488 | 488 | 493 | 976 | 976 | 986 |
| 245 | 245 | 245 | 245 | 245 | 247 | 490 | 490 | 495 | 980 | 980 | 989 |
| 246 | 246 | 246 | 246 | 246 | 248 | 492 | 492 | 496 | 984 | 984 | 992 |
| 247 | 247 | 247 | 247 | 247 | 249 | 494 | 494 | 498 | 988 | 988 | 996 |
| 248 | 248 | 248 | 248 | 248 | 250 | 496 | 496 | 499 | 992 | 992 | 999 |
| 249 | 249 | 249 | 249 | 249 | 250 | 498 | 498 | 501 | 996 | 996 | 1002 |
| 250 | 250 | 250 | 250 | 250 | 251 | 500 | 500 | 502 | 1000 | 1000 | 1005 |
| 251 | 251 | 251 | 251 | 251 | 252 | 502 | 502 | 504 | 1004 | 1004 | 1008 |
| 252 | 252 | 252 | 252 | 252 | 253 | 504 | 504 | 505 | 1008 | 1008 | 1011 |
| 253 | 253 | 253 | 253 | 253 | 253 | 506 | 506 | 507 | 1012 | 1012 | 1014 |
| 254 | 254 | 254 | 254 | 254 | 254 | 508 | 508 | 508 | 1016 | 1016 | 1017 |
| 255 | 255 | 255 | 255 | 255 | 255 | 510 | 510 | 510 | 1020 | 1020 | 1020 |

The color systems, which need to be improved, include the colors with the most serious and second most serious color shifts, the other color system is kept at the original input signal.

Based on FIGS. 1 to 3, it is obtained that the color with the most serious color shift is the B color, the color with the second most serious color shift is the R color, the color shift grayscales of the B color range from 0 to 59. The portion of the color shift grayscales is deleted from the original grayscales (0 to 255) to obtain the mapping grayscales thereof ranging from 60 to 255. The color shift grayscales of the R color range from 0 to 55, and the portion of the color shift grayscales thereof is removed from the original grayscales (0 to 255) thereof to obtain the mapping grayscales ranging from 56 to 255. The other color system in the input signal is kept at the grayscales of the original input signal, and then all the signals are outputted after adopting the 10/12-bit drive semiconductor element or the frame ratio control, and the details are shown in Table 6.

Table 6 is a grayscale table showing the B color with the serious color shift and the R color with the second most serious color shift as the target color system, wherein the other color system is kept at the grayscales corresponding to the original input signal and obtained after the 10/12-bit processing is adopted.

TABLE 6

| Original grayscales (8 bits) | | | Mapping grayscales (8 bits) | | | Mapping grayscales (10 bits) | | | Mapping grayscales (10 bits) | | |
|---|---|---|---|---|---|---|---|---|---|---|---|
| R | G | B | R | G | B | R | G | B | R | G | B |
| 0 | 0 | 0 | 56 | 0 | 60 | 112 | 0 | 120 | 224 | 0 | 240 |
| 1 | 1 | 1 | 57 | 1 | 61 | 114 | 2 | 122 | 227 | 4 | 243 |
| 2 | 2 | 2 | 58 | 2 | 62 | 115 | 4 | 123 | 230 | 8 | 246 |
| 3 | 3 | 3 | 58 | 3 | 62 | 117 | 6 | 125 | 233 | 12 | 249 |
| 4 | 4 | 4 | 59 | 4 | 63 | 118 | 8 | 126 | 236 | 16 | 252 |
| 5 | 5 | 5 | 60 | 5 | 64 | 120 | 10 | 128 | 240 | 20 | 255 |
| 6 | 6 | 6 | 61 | 6 | 65 | 121 | 12 | 129 | 243 | 24 | 258 |
| 7 | 7 | 7 | 61 | 7 | 65 | 123 | 14 | 131 | 246 | 28 | 261 |
| 8 | 8 | 8 | 62 | 8 | 66 | 124 | 16 | 132 | 249 | 32 | 264 |
| 9 | 9 | 9 | 63 | 9 | 67 | 126 | 18 | 134 | 252 | 36 | 268 |
| . | . | . | . | . | . | . | . | . | . | . | . |
| . | . | . | . | . | . | . | . | . | . | . | . |
| . | . | . | . | . | . | . | . | . | . | . | . |
| 244 | 244 | 244 | 246 | 244 | 247 | 493 | 488 | 493 | 986 | 976 | 986 |
| 245 | 245 | 245 | 247 | 245 | 247 | 494 | 490 | 495 | 989 | 980 | 989 |
| 246 | 246 | 246 | 248 | 246 | 248 | 496 | 492 | 496 | 992 | 984 | 992 |
| 247 | 247 | 247 | 249 | 247 | 249 | 498 | 494 | 498 | 995 | 988 | 996 |
| 248 | 248 | 248 | 250 | 248 | 250 | 499 | 496 | 499 | 998 | 992 | 999 |
| 249 | 249 | 249 | 250 | 249 | 250 | 501 | 498 | 501 | 1001 | 996 | 1002 |
| 250 | 250 | 250 | 251 | 250 | 251 | 502 | 500 | 502 | 1004 | 1000 | 1005 |
| 251 | 251 | 251 | 252 | 251 | 252 | 504 | 502 | 504 | 1008 | 1004 | 1008 |
| 252 | 252 | 252 | 253 | 252 | 253 | 505 | 504 | 505 | 1011 | 1008 | 1011 |
| 253 | 253 | 253 | 253 | 253 | 253 | 507 | 506 | 507 | 1014 | 1012 | 1014 |
| 254 | 254 | 254 | 254 | 254 | 254 | 508 | 508 | 508 | 1017 | 1016 | 1017 |
| 255 | 255 | 255 | 255 | 255 | 255 | 510 | 510 | 510 | 1020 | 1020 | 1020 |

Figure 5:
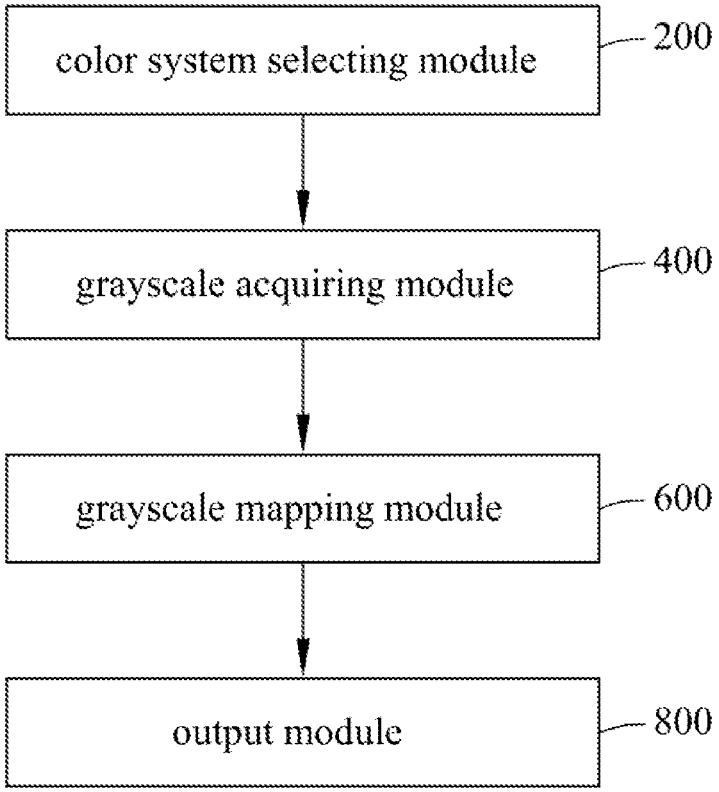
FIG. 5 is a schematic structure view showing a driving apparatus of a display device according to one of embodiments of the invention.

Referring to FIG. 5, a driving apparatus of a display device includes a color system selecting module 200, a grayscale acquiring module 400, a grayscale mapping module 600 and an output module 800.

The color system selecting module 200 acquires a to-be-adjusted target color system.

The grayscale acquiring module 400 acquires original grayscales corresponding to the target color system in the input signal and color shift grayscales corresponding to the color shift generated by the target color system.

The grayscale mapping module 600 deletes a portion of the original grayscales corresponding to the target color system and being smaller than the color shift grayscales to obtain mapping grayscales corresponding to the target color system.

The output module 800 adopts the high-bit drive semiconductor element or the frame ratio control to output the signal of the mapping grayscales corresponding to the target color system, wherein the high bit is higher than the original bit corresponding to the input signal.

In the driving apparatus of the display device of the invention, the color system selecting module 200 acquires the to-be-adjusted target color system; the grayscale acquiring module 400 acquires the color shift grayscales corresponding to the color shift generated by the target color system, and acquires the original grayscales corresponding to the target color system from the input signal; the grayscale mapping module 600 deletes the portion of the color shift grayscales from the original grayscales to obtain mapping grayscales corresponding to the target color system; and the output module 800 adopts the high-bit drive semiconductor element or the frame ratio control to output the signal of the mapping grayscales corresponding to the target color system. In the overall process, the low grayscales affecting the garishness performance in the target color system are deleted, and the high-bit drive semiconductor element or the frame ratio control is adopted to output the signal to effectively improve the color shift picture quality of the display device without sacrificing the performance of the full grayscale resolution.

In one of embodiments, the color system selecting module 200 includes an acquiring unit and a selecting unit.

The acquiring unit acquires the color shift condition data corresponding to each color system from the input signal.

The selecting unit selects the color with the minimum color shift value as the target color system, or selects the color with the maximum color shift value as the target color system. Alternatively, the selecting unit selects the color with the maximum color shift value and the color with the second highest color shift value as the target color systems.

In one of embodiments, the grayscale acquiring module 400 further acquires a chromaticity variation curve of the target color system, and acquires the color shift grayscales corresponding to the color shift generated by the target color system according to the chromaticity variation curve.

Figure 6:
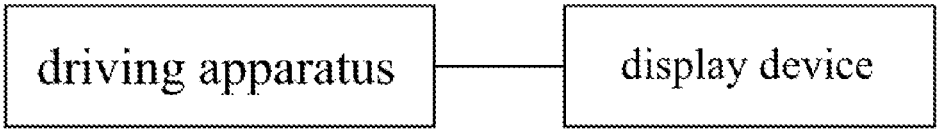
FIG. 6 is a block diagram showing a display device.

It should be noted that the driving method and the driving apparatus of a display device can be applied to various kinds of display device, as shown in FIG. 6. The display device can be any kind of display device, such as a liquid crystal panel, an OLED (Organic Light-Emitting Diode) panel, a QLED (Quantum Dot Light Emitting Diodes) panel, or a curved panel.

The above contents with the specific embodiments of the present invention is further made to the detailed description, and specific embodiments of the present invention should not be considered limited to these descriptions. Those of ordinary skill in the art for the present invention, without departing from the spirit of the present invention, can make various simple deduction or replacement, and should be deemed to belong to the scope of the present invention.

What is claimed is:

1. A driving method of a display device, comprising:

acquiring a target color system which is to-be-adjusted;

acquiring original grayscales corresponding to the target color system in an input signal and color shift grayscales corresponding to a color shift generated by the target color system;

deleting a portion of the original grayscales corresponding to the target color system which is smaller than the color shift grayscales to obtain mapping grayscales corresponding to the target color system, and adopting a high-bit drive semiconductor element or a frame ratio control, and outputting a signal of the mapping grayscales corresponding to the target color system, wherein the high bit is higher than the original bit corresponding to the input signal, wherein the original grayscales range from 0 to 255*M grayscales, the color shift grayscales corresponding to red range from 0 to 55*M grayscales, the color shift grayscales corresponding to green range from 0 to 31*M grayscales, the color shift grayscales corresponding to blue range from 0 to 59*M grayscales, the mapping grayscales corresponding to red range from 56*M to 255*M grayscales, the mapping grayscales corresponding to green range from 32*M to 255*M grayscales, the mapping grayscales corresponding to blue range from 60*M to 255*M grayscales, and M is one or an even number.

2. The method according to claim 1, wherein during acquiring the color shift grayscales corresponding to the color shift generated by the target color system, the method further comprises:

acquiring a chromaticity variation curve of the target color system, and acquiring the color shift grayscales corresponding to the color shift generated by the target color system according to the chromaticity variation curve.

3. The method according to claim 1, wherein during acquiring the target color system which is to-be-adjusted, the method further comprises:

acquiring color shift condition data corresponding to each color system from the input signal, and selecting the color with the maximum color shift value as the target color system.

4. The method according to claim 1, wherein during acquiring the target color system which is to-be-adjusted, the method further comprises:

acquiring color shift condition data corresponding to each color system from the input signal, and selecting the color with the minimum color shift value as the target color system.

5. The method according to claim 1, wherein during acquiring the target color system which is to-be-adjusted, the method further comprises:

acquiring color shift condition data corresponding to each color system from the input signal; and selecting the color with the maximum color shift value and the color with the second highest color shift value as the target color system.

6. The method according to any one of claims 1 to 5, wherein the target color system is a solid color, and before the step of adopting the high-bit drive semiconductor element or the frame ratio control and outputting the signal of the mapping grayscales corresponding to the target color system, the method further comprises:

acquiring the original grayscales corresponding to each color system from the input signal, and deleting the portion of the original grayscales corresponding to each color system which is lower than the color shift grayscales to obtain the mapping grayscales corresponding to each color system, and wherein during adopting the high-bit drive semiconductor element or the frame ratio control and outputting the signal of the mapping grayscales corresponding to the target color system, the method further comprises:

adopting the high-bit drive semiconductor element or the frame ratio control and outputting the signal of the mapping grayscales corresponding to each color system.

7. The method according to claim 1, wherein during acquiring original grayscales corresponding to the target color system in the input signal, the method further comprises:

acquiring a configuration parameter of the display device, and acquiring the original grayscales corresponding to the target color system from the input signal according to the configuration parameter.

8. A driving apparatus of a display device, comprising:

a color system selecting module for acquiring a target color system which is to-be-adjusted;

a grayscale acquiring module for acquiring original grayscales corresponding to the target color system in an input signal and color shift grayscales corresponding to the color shift generated by the target color system;

a grayscale mapping module for deleting a portion of the original grayscales corresponding to the target color system which is smaller than the color shift grayscales and obtaining mapping grayscales corresponding to the target color system, and an output module for adopting a high-bit drive semiconductor element or a frame ratio control and outputting the signal of the mapping grayscales corresponding to the target color system, wherein the high bit is higher than the original bit corresponding to the input signal, wherein the original grayscales range from 0 to 255*M grayscales, the color shift grayscales corresponding to red range from 0 to 55*M grayscales, the color shift grayscales corresponding to green range from 0 to 31*M grayscales, the color shift grayscales corresponding to blue range from 0 to 59*M grayscales, the mapping grayscales corresponding to red range from 56*M to 255*M grayscales, the mapping grayscales corresponding to green range from 32*M to 255*M grayscales, the mapping grayscales corresponding to blue range from 60*M to 255*M grayscales, and M is one or an even number.

9. The apparatus according to claim 8, wherein the color system selecting module comprises:

an acquiring unit for acquiring the color shift condition data corresponding to each color system from the input signal, and a selecting unit for selecting the color with the minimum color shift value as the target color system, or selecting the color with the maximum color shift value as the target color system.

10. The apparatus according to claim 8, wherein the grayscale acquiring module further acquires a chromaticity variation curve of the target color system, and acquires the color shift grayscales corresponding to the color shift generated by the target color system according to the chromaticity variation curve.

11. The apparatus according to claim 8, wherein the target color system is a solid color, and the output module further acquires the original grayscales corresponding to each of the color systems from the input signal, deletes a portion of the original grayscales corresponding to each of the color systems and being lower than the color shift grayscales to obtain the mapping grayscales corresponding to each of the color systems, and adopts a high-bit drive semiconductor element or frame ratio control to output the signal of the mapping grayscales corresponding to each of the color systems.

12. The apparatus according to claim 8, wherein the grayscale acquiring module further acquires a configuration parameter of the display device, and acquires the original grayscales corresponding to the target color system from the input signal according to the configuration parameter.

13. A driving method of a display device, wherein the target color system is a solid color, the method comprising:

acquiring color shift condition data corresponding to each color system from a input signal;

selecting the color with the minimum color shift value as the target color system, or selecting the color with the maximum color shift value as the target color system, or selecting the color with the maximum color shift value and the color with the second highest color shift value as the target color system;

acquiring original grayscales corresponding to the target color system in the input signal, acquiring a chromaticity variation curve of the target color system, and acquiring the color shift grayscales corresponding to the color shift generated by the target color system according to the chromaticity variation curve;

acquiring the original grayscales corresponding to each color system from the input signal;

deleting a portion of the original grayscales corresponding to each color system which is lower than the color shift grayscales to obtain the mapping grayscales corresponding to each color system, and adopting a high-bit drive semiconductor element or a frame ratio control, and outputting a signal of the mapping grayscales corresponding to each color system, wherein the original grayscales range from 0 to 255*M grayscales, the color shift grayscales corresponding to red range from 0 to 55*M grayscales, the color shift grayscales corresponding to green range from 0 to 31*M grayscales, the color shift grayscales corresponding to blue range from 0 to 59*M grayscales, the mapping grayscales corresponding to red range from 56*M to 255*M grayscales, the mapping grayscales corresponding to green range from 32*M to 255*M grayscales, the mapping grayscales corresponding to blue range from 60*M to 255*M grayscales, and M is one or an even number.

* * * * *